US007553243B2

(12) United States Patent
Endo et al.

(10) Patent No.: US 7,553,243 B2
(45) Date of Patent: Jun. 30, 2009

(54) GOLF BALL

(75) Inventors: Kiyoshi Endo, 13-21-601, Kitahorie 4-chome, Nishi-ku, Osaka-shi, Osaka (JP); Toshiyuki Tarao, Kobe (JP)

(73) Assignees: Kiyoshi Endo, Osaka-shi, Osaka (JP); SRI Sports Limited, Kobe-shi, Hyogo (JP)

( * ) Notice: Subject to any disclaimer, the term of this patent is extended or adjusted under 35 U.S.C. 154(b) by 0 days.

(21) Appl. No.: 11/798,153

(22) Filed: May 10, 2007

(65) Prior Publication Data

US 2007/0265112 A1 Nov. 15, 2007

(30) Foreign Application Priority Data

May 11, 2006 (JP) ..... 2006-133110
Dec. 28, 2006 (JP) ..... 2006-355732

(51) Int. Cl.
*A63B 37/00* (2006.01)

(52) U.S. Cl. ..... 473/351

(58) Field of Classification Search ..... 473/351, 473/377

See application file for complete search history.

(56) References Cited

U.S. PATENT DOCUMENTS 6,692,381 B2 2/2004 Sakagami et al.
2006/0094832 A1 * 5/2006 Sakagami et al. ..... 525/343

FOREIGN PATENT DOCUMENTS

JP 2002-282393 A 10/2002
JP 2002-338737 A 11/2002

OTHER PUBLICATIONS

Kiyosho Endo et al., 1,4 Cis Selectivity and Molecular Weight COntrol of Polymer in the Polymerization of 1,3-Butadiene with Metallosalen Complexes/Methylaluminoxane Catalysts, 2005, e-journal.*

* cited by examiner

*Primary Examiner*—Raeann Trimiew
(74) *Attorney, Agent, or Firm*—Birch, Stewart, Kolasch & Birch, LLP

(57) ABSTRACT

The object of the present invention is to improve the resilience and the shot feeling of the golf ball to be obtained by reducing the content of trans-1,4-bond in a golf ball using for a core a polybutadiene having a high content of cis-1,4-bond. The golf ball of the present invention has a core comprising at least one layer or more and a cover covering the core, at least one layer of the core obtained by molding a rubber composition containing (a) a base rubber containing a polybutadiene obtained by polymerizing 1,3-butadiene in the presence of a catalyst containing a metallosalen complex and aluminoxane, (b) a co-crosslinking agent, and (c) a crosslinking agent.

11 Claims, 2 Drawing Sheets

GOLF BALL

BACKGROUND OF THE INVENTION

1. Field of the Invention

The present invention relates to a golf ball, more particularly to a technology for improving resilience and shot feeling of a rubber composition used for a core of the golf ball.

2. Description of the Related Art

In a golf ball comprising a core consisting of at least one layer and a cover covering the core, the core is generally a molded body of a rubber composition containing a base rubber, a co-crosslinking agent and a crosslinking agent. The characteristics of a golf ball such as resilience and shot feeling are highly affected by the rubber composition constituting the core, and thus the improvement of the rubber composition has been under investigation. In order to improve resilience, a polybutadiene (so called high cis-polybutadiene) containing a high content of cis-1,4-bond is used for the rubber composition as the base rubber.

For example, Japanese patent publication No. 2002-282393A discloses a polybutadiene with 99% or more of cis-1,4-bond synthesized using a catalyst consisting of a composition which comprises a metallocene catalyst of a rare-earth metal compound, an ionic compound consisting of an uncoordinated anion and a cation, and/or aluminoxane. Additionally, Japanese patent publication No. 2002-338737A discloses a polybutadiene with 80% or more of cis-1,4-bond having a molecular weight distribution (Mw/Mn) of 1.2 to 2.0 synthesized using a catalyst consisting of a composition which comprises a metallocene catalyst of a rare-earth metal compound, an ionic compound consisting of an uncoordinated anion and a cation, and/or aluminoxane.

As described above, in a technology wherein the metallocene catalyst is used to enhance the rate of content of cis-1,4-bond, there exists a problem that it is unsuitable for industrial use since the metallocene catalyst is unstable in the air. Additionally, the polybutadiene has bonding types such as trans-1,4-bond and 1,2-vinyl bond other than cis-1,4-bond, and it is known that the reduction of the content of trans-1,4-bond enhances the resilience.

SUMMARY OF THE INVENTION

The object of the present invention is to improve the resilience and the shot feeling of a golf ball to be obtained by lowering the content of trans-1,4-bond contained in a golf ball using a polydiene containing a high content of cis-1,4-bond as the core.

A golf ball of the present invention that has solved the above problem is a golf ball having a core consisting of at least one layer and a cover covering the core, wherein at least one layer of the core is obtained by molding a rubber composition which comprises (a) a base rubber containing a polydiene obtained by polymerizing a diene in the presence of a catalyst containing a metallosalen complex and aluminoxane;
(b) a co-crosslinking agent; and
(c) a crosslinking agent.

The gist of the present invention resides in using the polydiene obtained by polymerizing the diene in the presence of the catalyst containing the metallosalen complex and aluminoxane, as the base rubber of the rubber composition constituting the core of the golf ball. By polymerizing the diene in the presence of the catalyst containing the metallosalen complex and the aluminoxane, the resultant polydiene can contain 90% or more of cis-1,4-bond and, at the same time, 1% or less of trans-1,4-bond. As a result, the resilience and the shot feeling of the resultant golf ball are improved by using the polydiene for the core.

Preferred examples of the diene include 1,3-butadiene, 2-methyl-1,3-butadiene, 2-ethyl-1,3-butadiene, 2,3-dimethyl-1,3-butadiene, 1,3-pentadiene, 2-methyl-1,3-pentadiene, 4-methyl-1,3-pentadiene and 2,4-hexadiene, more particularly 1,3-butadiene.

Examples of the metal of the metallosalen complex include nickel, cobalt, iron, titanium and vanadium. As the catalyst, a catalyst consisting of a cobalt salen complex and methylaluminoxane is preferably used.

The present invention provides a golf ball which is excellent in resilience and shot feeling.

DESCRIPTION OF THE PREFERRED EMBODIMENT

Figure 1:
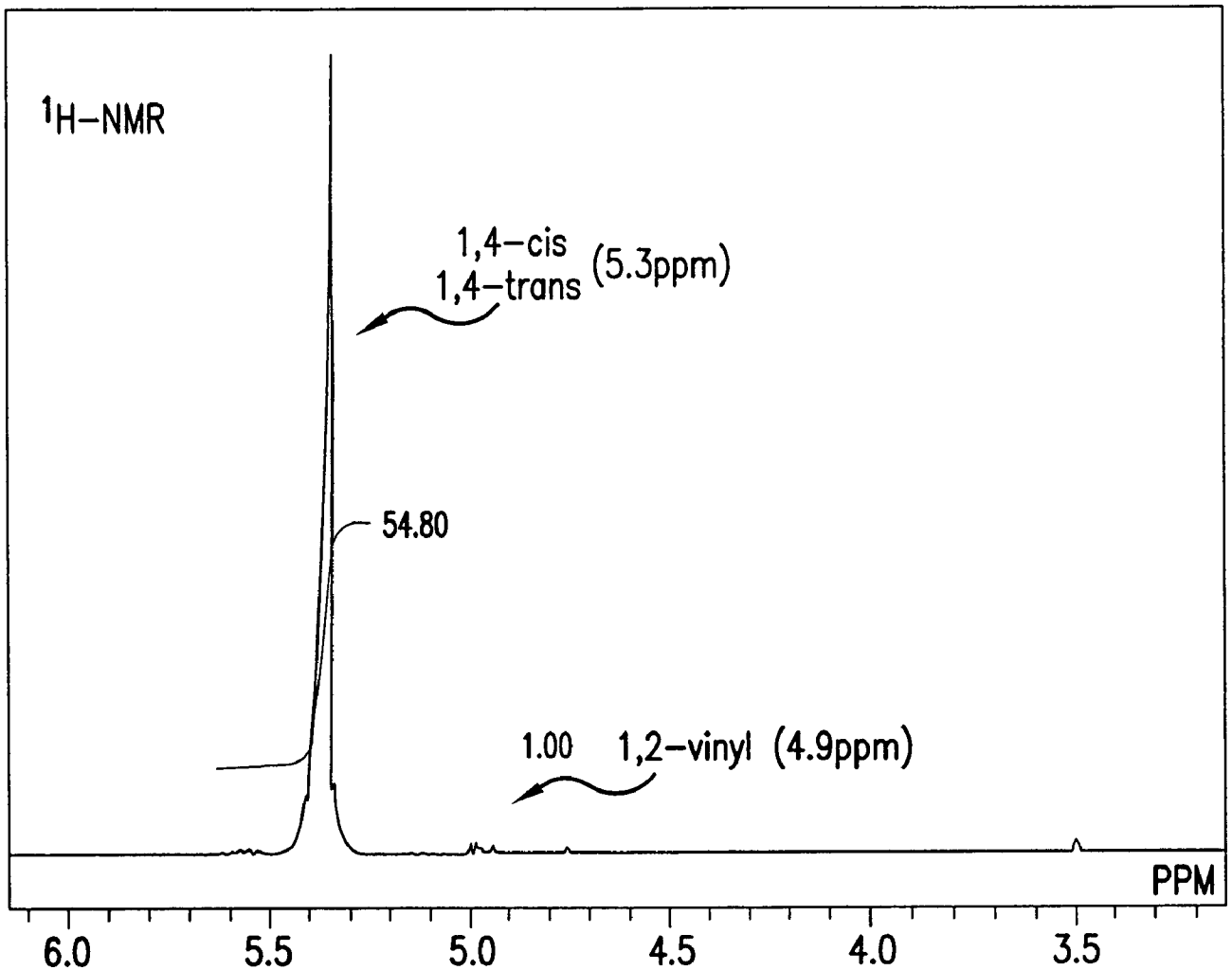
FIG. 1 is a $^{1}$H-NMR chart showing an example of the polybutadiene.

The golf ball of the present invention has a core consisting of at least one layer and a cover covering the core, wherein at least one layer of the core is obtained by molding a rubber composition which comprises:

(a) a base rubber containing a polydiene obtained by polymerizing a diene in the presence of a catalyst containing a metallosalen complex and aluminoxane;
(b) a co-crosslinking agent; and
(c) a crosslinking agent.

First, an explanation of (a) the base rubber containing the polydiene obtained by polymerizing the diene in the presence of the catalyst containing the metallosalen complex and aluminoxane (hereinafter occasionally referred to as "high-cis/low-trans polydiene") will be provided.

The metallosalen complex is a complex consisting of a salen ligand [N,N'-bis(salicyldene)ethylenediamine] or a derivative thereof and a metal, for example, expressed by the following chemical Formula (1) or (2):

(1)

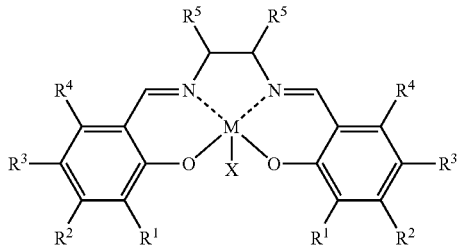

(2)

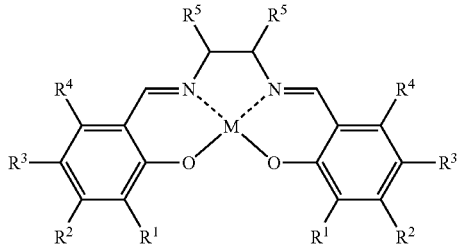

In the Formula, $R^1$, $R^2$, $R^3$, and $R^4$ may be either same or different, and are an alkyl group having 1 to 10 carbon atoms (preferably an alkyl group having 1 to 4 carbon atoms), one in which a part of hydrogen thereof is substituted with halogen, or hydrogen. More preferably, $R^1$ or both $R^1$ and $R^3$ are an alkyl group having 1 to 10 carbon atoms (preferably an alkyl group having 1 to 4 carbon atoms), wherein $R^2$ and $R^4$ are hydrogen. $R^5$ is an alkyl group having 1 to 10 carbon atoms or one in which a part of hydrogen thereof is substituted with halogen, a phenyl group or one in which a part of hydrogen thereof is substituted with halogen, or hydrogen, and further, the neighboring two $R^5$ may form a benzene ring or a cyclohexyl ring. M is a metal and X is an anion.

The salen ligand is synthesized by a dehydration-condensation reaction of a corresponding salicylaldehyde and a derivative of ethylenediamine.

Examples of the corresponding salicylaldehyde include salicylaldehyde, 2-hydroxy-3,5-dimethyl benzaldehyde, 2-hydroxy-5-methyl benzaldehyde, 5-tert-butyl-2-hydroxy benzaldehyde and 3,5-di-tert-butyl-2-hydroxy benzaldehyde. Examples of the ethylenediamine derivative include 1,2-ethane diamine, 1,2-benzene diamine, 1,2-cyclohexane diamine such as (1R,2S)-1,2-cyclohexane diamine, (1S,2S)-1,2-cyclohexane diamine, (1R,2R)-1,2-cyclohexane diamine or trans-1,2-cyclohexane diamine.

The metal of the metallosalen complex is not particularly limited. Examples of the metal include nickel, cobalt, iron, titanium and vanadium, and cobalt is particularly preferred.

Examples of the anion X of the metallosalen complex include anions such as a hydroxide ion ($OH^-$); a halonium such as chloride ion ($Cl^-$), a bromide ion ($Br^-$) and a fluoride ion ($F^-$); an acetate ion ($CH_3COO^-$); a nitrate ion ($NO_3^-$); a sulfate ion ($SO_4^{2-}$), an oxalate ion ($C_2O_4^{2-}$); a phosphate ion ($PO_4^-$) and a hexa-fluorophosphate ion ($PF_6^-$). In the present invention, a metallosalen complex devoid of anion X as represented by the Formula (2) can be used.

As the metallosalen complex, N,N'-bis(3-tert-butylsalicylidene)ethylenediaminato Cobalt(II) (Formula (3)), N,N'-bis(3-tert-butyl-5-methylsalicylidene)ethylenediaminato Cobalt(II) (Formula (4)), N,N'-bis(3,5-di-tert-butylsalicylidene)ethylenediaminato Cobalt(II) (Formula (5)) N,N'-bis(3,5-di-tert-butylsalicylidene)1,2-diphenylethylene diaminato Cobalt (II) (Formula (6)) and the like are particularly preferred.

(3)

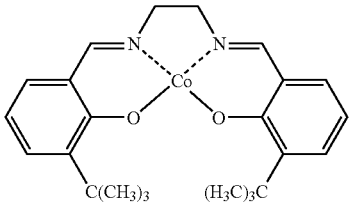

(4)

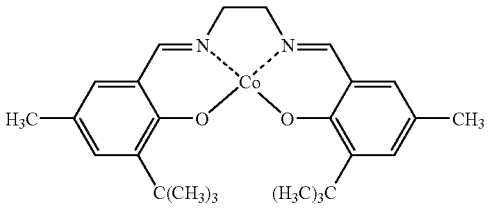

-continued (5)

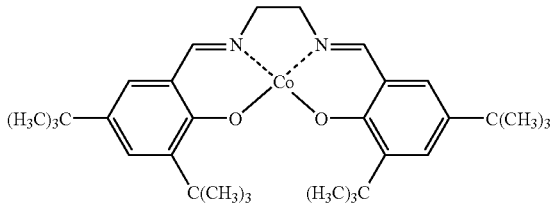

(6)

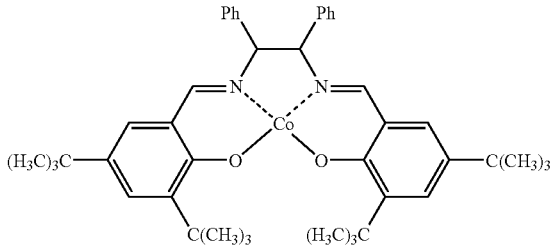

As the aluminoxane, for example, one obtained by bringing an organic aluminum compound (preferably a trimethyl aluminum) in contact with a condensation agent (preferably water), more specifically one having a structure represented by the following Formula (7), may be used.

(7)

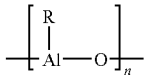

In the Formula, R is a hydrocarbon group having 1 to 10 carbon atoms (preferably having 1 to 4 carbon atoms), and may be same or different in a neighboring constitutional unit, but preferably the same. The hydrocarbon group may be substituted with a halogen atom and/or an alkoxy group. n represents the degree of polymerization, and it is an integer of 4 to 20. R includes, for example, a methyl group, an ethyl group, a propyl group and an isobutyl group, and a methyl group is preferred. Examples of the organic aluminum compound used as a raw material of aluminoxane include a trialkyl aluminum such as trimethyl aluminum, triethyl aluminum, tributyl aluminum and a mixture thereof, preferably the trimethyl aluminum. Further, aluminoxane comprising a mixture of trimethyl aluminum and tributyl aluminum as the raw material may be used. In the present invention, in Formula (7), methylaluminoxane wherein R of all the constituent units are methyl groups is particularly preferred.

The high-cis/low-trans polydiene used in the present invention is not particularly limited as long as it is obtained by polymerization in the presence of the catalyst containing the metallosalen complex and the aluminoxane. The catalyst may further contain diethyl aluminum chloride ($Et_2AlCl$) and the like. In a preferred embodiment, the catalyst essentially consisting of the aforementioned metallosalen complex and the aluminoxane is used.

Examples of the diene used in the present invention include a conjugated diene such as 1,3-butadiene, 2-methyl-1,3-butadiene, 2-ethyl-1,3-butadiene, 2,3-dimethyl-1,3-butadiene, 1,3-pentadiene, 2-methyl-1,3-pentadiene, 4-methyl-1,3-pentadiene, 1,3-hexane diene and 2,4-hexadiene; particularly preferred is 1,3-butadiene.

In a polyhexadiene formed by polymerizing 2,4-hexadiene, cis-2,5-bond and trans-2,5-bond are formed. Herein, these cis-2,5-bond and trans-2,5-bond are assumed cis-1,4-bond and trans-1,4-bond respectively to calculate the content of cis-1,4-bond and trans-1,4-bond. Further, with regard to a diene having 6 or more carbon atoms, the rate of content of cis-1,4-bond and trans-1,4-bond is calculated in the same manner.

A method of polymerizing the diene in the presence of the catalyst containing the metallosalen complex and the aluminoxane is not particularly limited. The polymerization temperature, for example, is preferably 0° C. or more, more preferably 10° C. or more, and preferably 100° C. or less, more preferably 80° C. or less. The polymerization time is preferably 0.5 hour or more, more preferably 1 hour or more, and preferably 12 hours or less, more preferably 6 hours or less.

The amount of the metallosalen complex and the aluminoxane to be used is not particularly limited, but the metallosalen complex is preferably used in an amount of 0.01 part or more, more preferably 0.05 part or more, and preferably 2 parts or less, more preferably 1 part or less relative to 100 parts of the diene by mass. Further, the aluminoxane is preferably used in an amount of 1 part or more, more preferably 3 parts or more, and preferably 40 parts or less, more preferably 30 parts or less relative to 100 parts of the diene by mass.

The polymerization is preferably carried out in a solvent for dissolving the diene, the metallosalen complex and the aluminoxane. As the solvent, a halogenated solvent and a non-halogenated solvent may be used, and a halogenated solvent to which the metallosalen complex has high solubility is preferably used.

Examples of the halogenated solvent include mono, di or tri-halogen-substituted alkane such as methylene chloride, dichloromethane, chloroform, chloroethane, bromopropane, bromobutane, iodomethyl propane and fluoromethyl propane; and mono, di, or tri-halogen-substituted benzene such as chloro benzene, dichlorobenzene, bromobenzene, tribromobenzene, and iodobenzene. Among them, methylene chloride, dichloromethane and chloroform are preferred.

Examples of the non-halogenated solvent include an aromatic solvent such as benzene, toluene and nitrobenzene; an aliphatic hydrocarbon solvent such as pentane, hexane, heptane and octane; dimethyl formamide (DMF) and dimethyl acetamide (DMA).

Further, the catalytic activity can be enhanced by controlling the addition order of the metallosalen complex, the aluminoxane and the diene depending on the kind of metal of the metallosalen complex. For example, when using the cobalt salen complex, it is a preferred embodiment to add the cobalt salen complex into the diene before activating with the aluminoxane, and the yield of the resultant polymer can be enhanced by adding the materials in order as mentioned above. In the nickel salen complex, the influence of the addition order is hardly recognized.

The high-cis/low-trans polydiene used in the present invention preferably contains cis-1,4-bond in an amount of 90% or more, more preferably 96% or more, even more preferably 99% or more. Additionally, the polydiene preferably contains trans-1,4-bond in an amount of 1% or less, more preferably 0.8% or less, even more preferably 0.5% or less, further more preferably 0.3% or less. By increasing the content of cis-1,4-bond and reducing the content of trans-1,4-bond, a golf ball which is excellent in resilience and shot feeling can be obtained. Therefore, the polydiene most preferably contains trans-1,4-bond in the amount of 0%.

Since the polydiene has the bonding type of 1,2-vinyl bond in addition to the cis-1,4-bond and the trans-1,4-bond, even if the content of the cis-1,4-bond is increased, it does not mean that the content of trans-1,4-bond is directly decreased. The present invention is characterized by a use of a polydiene having a high content of cis-1,4-bond and a low content of trans-1,4-bond. The content of trans-1,4-bond, cis-1,4-bond and 1,2-vinyl bond can be calculated by using $^{1}$H-NMR and $^{13}$C-NMR.

Herein, cis-1,4-bond, trans-1,4-bond and 1,2-vinyl bond are defined, for example, as follows in the polydiene represented by the following Formula (8):

$$\text{cis-1,4-bond}(\%)=100\times X/(X+Y+Z)$$

$$\text{trans-1,4-bond}(\%)=100\times Y/(X+Y+Z)$$

$$\text{1,2-vinyl bond}(\%)=100\times Z/(X+Y+Z)$$

(8)

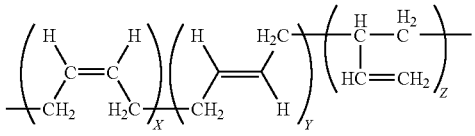

cis-1,4-bond trans-1,4-bond 1,2-vinyl-bond wherein X, Y, and Z represent the number of units of each constituent unit.

The rubber composition used in the present invention may contain, in addition to the abovementioned high-cis/low-trans polydiene, another rubber component as the base rubber, unless the effects of the present invention is deteriorated. Examples of the other rubber components may be one, two or more kinds among polybutadiene, ethylene-propylene-diene terpolymer (EPDM), isoprene rubber (IR), butyl rubber (IIR), natural rubber (NR), nitrile rubber (NBR), styrene rubber (SBR) and the like. Among them, preferably used is a high cis-polybutadiene containing a cis bond with advantageous resilience in an amount of 40% or more, more preferably 70% or more, even more 90% or more.

The content of high-cis/low-trans polybutadiene in the base rubber is preferably 50% or more, more preferably 60% or more, even more preferably 70% or more. It is also a preferred embodiment that the base rubber to be used essentially consists of the high-cis/low-trans polydiene.

The co-crosslinking agent (b) contained in the rubber composition used in the present invention is not particularly limited as long as it has an action of crosslinking rubber molecules by graft polymerization to a rubber molecular chain, and such examples include an α,β-unsaturated carboxylic acid and/or a metal salt thereof. Examples of the α,β-unsaturated carboxylic acid and/or the metal salt thereof include an α,β-unsaturated carboxylic acid having 3 to 8 carbon atoms and/or a metal salt thereof, more preferably acrylic acid, methacrylic acid, zinc acrylate, zinc methacrylate and the like. In particular, it is a preferred embodiment to use zinc salt or magnesium salt as the metal salt, which can enhance the resilience of the resultant golf ball.

The content of the co-crosslinking agent (b) in the rubber composition is preferably 15 parts or more, more preferably 20 parts or more, even more preferably 25 parts or more relative to 100 parts of the base rubber by mass. If the content of the co-crosslinking agent is 15 parts or more by mass, the molded body obtained by molding the rubber composition can have an appropriate hardness. If the molded body is too soft, the deformation amount thereof when being hit may become so large that the shot feeling may be lowered. Additionally, the content of (b) the co-crosslinking agent in the rubber composition is preferably 45 parts or less, more preferably 38 parts or less, even more preferably 35 parts or less relative to 100 parts of the base rubber by mass. By containing 45 parts or less of the co-crosslinking agent by mass, a preferable shot feeling can be obtained.

The crosslinking agent (c) contained in the rubber composition used in the present invention is blended to crosslink the base rubber component. The crosslinking agent is preferably blended in an amount of 0.2 part or more, more preferably 0.5 part or more, and is preferably blended in an amount of 5 parts or less, more preferably 3 parts or less relative to 100 parts of the base rubber by mass.

As the crosslinking agent, an organic peroxide is preferably used, and such examples include dicumyl peroxide, 1,1-bis(t-butylperoxy)-3,5-trimethylcyclohexane, 2,5-dimethyl-2,5-di(t-butylperoxy)hexane and di-t-butyl peroxide. Among them, dicumyl peroxide is preferably used.

The rubber composition used in the present invention may contain, in addition to each of the above components, an organic sulfur compound. The content of the organic sulfur compound is preferably 0.05 part or more, more preferably 0.3 part or more and is preferably 5.0 parts or less, more preferably 3.0 parts or less relative to 100 parts of the base rubber by mass.

As the organic sulfur compound, diphenyl disulfide or a derivative thereof are preferably used. Examples of the diphenyl disulfide or the derivative thereof include diphenyl disulfide; a mono-substituted diphenyl disulfide such as bis (4-chlorophenyl)disulfide, bis(3-chlorophenyl)disulfide, bis (4-bromophenyl)disulfide, bis(3-bromophenyl)disulfide, bis (4-fluorophenyl)disulfide, bis(4-iodophenyl)disulfide, and bis(4-cyanophenyl)disulfide; a di-substituted diphenyl disulfide such as bis(2,5-dichlorophenyl)disulfide, bis (3,5-dichlorophenyl)disulfide, bis(2,6-dichlorophenyl)disulfide, bis(2,5-dibromophenyl)disulfide, bis (3,5-dibromophenyl) disulfide, bis(2-chloro-5-bromophenyl)disulfide, and bis(2-cyano-5-bromophenyl)disulfide; a tri-substituted diphenyl disulfide such as bis (2,4,6-trichlorophenyl)disulfide, and bis (2-cyano-4-chloro-6-bromophenyl)disulfide; a tetra substituted diphenyl disulfide such as bis (2,3,5,6-tetrachlorophenyl)disulfide; a penta substituted diphenyl disulfide such as bis(2,3,4,5,6-pentachlorophenyl)disulfide and bis(2,3,4,5,6-pentabromophenyl)disulfide. These diphenyl disulfide and the derivative thereof have some influence on the state of vulcanization of the vulcanized rubber body, and enhance the resilience thereof. Among them, in view of obtaining the golf ball having high resilience, diphenyl disulfide, and bis(penta bromophenyl)disulfide are particularly preferred.

The rubber composition used in the present invention may further include an additive such as a pigment; a filler for adjusting specific gravity and the like; an antioxidant, an anti-aging agent, a peptizing agent, and a softening agent in addition to the above base rubber, the co-crosslinking agent and the crosslinking agent.

The filler is blended as a gravity adjusting agent mainly used for adjusting the specific gravity of a golf ball obtained as a final product within the range of 1.0 to 1.5, and it may be blended if necessary. The filler may be one which is usually blended in a core of a golf ball, for example, an inorganic filler (specifically zinc oxide, barium sulfate and calcium carbonate), a high gravity metal powder (e.g. tungsten powder and molybdenum powder) and a mixture thereof. Particularly preferred is zinc oxide which also serves as a vulcanization auxiliary agent. If zinc oxide is used, the content thereof is preferably 30 parts or less, more preferably 25 parts or less, even more preferably 15 parts or less relative to 100 parts of the base rubber by mass. If the content is more than 30 parts by mass, the content of the rubber component becomes too low to obtain high resilience.

The amount of the antioxidant to be blended is preferably 0.1 part or more and 1 part or less relative to 100 parts of the base rubber by mass. Further, the amount of the peptizing agent is preferably 0.1 part or more and 5 parts or less relative to 100 parts by mass of the base rubber by mass.

The conditions for molding the rubber composition into the molded body can be suitably determined depending on the rubber composition. The molding is usually carried out by heating the rubber composition at a temperature of 130° C. to 200° C. for 10 to 60 minutes. Alternatively, the molding is preferably carried out in a two-step heating, for 20 to 40 minutes at a temperature of 130° C. to 150° C. and continuously for 5 to 15 minutes at a temperature of 160° C. to 180° C.

The cover materials constituting the cover of the golf ball of the present invention is not particularly limited, and examples may include various resins such as an ionomer resin, a polyester resin, an urethane resin like a thermoplastic urethane resin or a two-component curing type urethane resin, and a polyamide resin, and a thermoplastic elastomer such as a thermoplastic polyamide elastomer having a commercial name "PEBAX", for example, "PEBAX 2533" available from ARKEMA Inc., a thermoplastic polyester elastomer having a commercial name "HYTREL" (registered trade name), for example "HYTREL 3548" and "HYTREL 4047" available from DU PONT-TORAY Co., a thermoplastic polyurethane elastomer having a commercial name "ELASTOLLAN" (registered trade name), for example "ELASTOLLAN XNY97A" available from BASF Japan, and a thermoplastic polystyrene elastomer having a commercial name "Rabalon" (registered trade name) available from Mitsubishi Chemical Co. The cover material may be used alone or as a mixture of two or more kind.

Examples of the ionomer resin include, in particular, an ionomer resin prepared by neutralizing at least a part of carboxyl groups in a copolymer composed of ethylene and α,β-unsaturated carboxylic acid having 3 to 8 carbon atoms with a metal ion, and one prepared by neutralizing at least a part of carboxyl groups in a ternary copolymer composed of ethylene, α,β-unsaturated carboxylic acid having 3 to 8 carbon atoms, and α,β-unsaturated carboxylic acid ester with a metal ion, or a mixture thereof.

Examples of the metal ion for neutralization include a monovalent metal ion such as a sodium ion, a potassium ion, a lithium ion; a bivalent metal ion such as a zinc ion, a calcium ion, a magnesium ion, a copper ion and a manganese ion; a trivalent metal ion such as an aluminum ion and a neodymium ion. In particular, a zinc ion is preferred because it has a high bond strength of an aggregate of metal ions and the decrease in the mechanical strength based on dispersion of crosslinked diene rubber particles is small.

Specific examples of the ionomer resin include Himilan 1605 (commercial name of a sodium ion-neutralized ethylene-methacrylic acid copolymer ionomer resin), Himilan 1707 (commercial name of a sodium ion-neutralized ethylene-methacrylic acid copolymer ionomer resin), Himilan 1706 (commercial name of a zinc ion-neutralized ethylene-methacrylic acid copolymer ionomer resin), Himilan AM7315 (commercial name of a zinc ion-neutralized ethylene-methacrylic acid copolymer ionomer resin), Himilan AM7317 (commercial name of a zinc ion-neutralized ethylene-methacrylic acid copolymer ionomer resin), Himilan 1555 (commercial name of a sodium ion-neutralized ethylene-methacrylic acid copolymer ionomer resin), and Himilan 1557 (commercial name of a zinc ion-neutralized ethylene-methacrylic acid copolymer ionomer resin) available from MITSUI-DUPONT POLYCHEMICAL.; Iotek 8000 (commercial name of a sodium ion-neutralized ethylene-methacrylic acid copolymer ionomer resin), Iotek 7010 (commercial name of a zinc ion-neutralized ethylene-methacrylic acid copolymer ionomer resin) available from Exxon Chemicals; and Surlyn 7930 (commercial name of a lithium ion-neutralized ethylene-methacrylic acid copolymer ionomer resin), Surlyn 9945 (commercial name of a zinc ion-neutralized ethylene-methacrylic acid copolymer ionomer resin), and Surlyn 8945 (commercial name of a sodium ion-neutralized ethylene-methacrylic acid copolymer ionomer resin) available from DUPONT CO.

Examples of the urethane resin or the polyurethane elastomer (hereinafter collectively referred to only as "urethane resin") constituting the cover include a two-component curing type urethane resin obtained by curing an isocyanate group terminated urethane prepolymer with an aromatic polyamine, or a thermoplastic urethane resin. The polyisocyanate component constituting the urethane resin is not particularly limited as long as it has 2 or more isocyanate groups, and such examples include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylenediisocyanate (TMXDI), paraphenylene diisocyanate (PPDI); and an alicyclic polyisocyanate or an aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), norbornene diisocyanate (NBDI). These may be used alone or as a mixture of two or more kinds. Among them, a non-yellowing type polyisocyanate (e.g. TMXDI, XDI, HDI, $H_6$XDI, IPDI, $H_{12}$MDI and NBDI) is preferably used in view of weather resistance.

The polyol component constituting the urethane resin is not particularly limited as long as it has a plurality of hydroxyl groups, and, for example, a polyol having a low molecular weight and a polyol having a high molecular weight may be used. Examples of the polyol having the low-molecular weight include a diol such as ethylene glycol, diethylene glycol, triethylene glycol, 1,3-butanediol, 1,4-butanediol, neopentyl glycol, and 1,6-hexanediol; and a triol such as glycerin, trimethylol propane, and hexanetriol. Examples of a polyol having a high molecular weight include a polyether polyol such as polyoxyethylene glycol (PEG), polyoxypropylene glycol (PPG) and polyoxytetramethylene glycol (PTMG); a condensed polyester polyol such as polyethylene adipate (PEA), polybutylene adipate (PBA) and polyhexamethylene adipate (PHMA); a lactone polyester polyol such as poly-ε-caprolactone (PCL); a polycarbonate polyol such as polyhexamethylene carbonate; and an acrylic polyol. Among the polyols as listed above, a polyol having a weight average molecular weight of 50 to 2,000, more specifically about 100 to 1,000 is preferably used. These polyols may be used alone or as a mixture of two or more kinds.

The aromatic polyamine is not particularly limited as long as, for example, it is a compound having at least two amino groups directly or indirectly bonded to an aromatic ring. Such examples include a type such as phenylenediamine, toluene diamine, and diethyltoluenediamine wherein the amino groups are directly bonded to the aromatic ring; a type wherein the amino groups are bonded to the aromatic ring through the sulfide bond such as dimethylthiotoluenediamine; a type such as xylylenediamine wherein the amino groups are bonded to the aromatic ring through a lower alkylene group; and 4,4'-diaminodiphenylmethane and a derivative thereof. The above-mentioned cover materials may further contain a gravity adjusting agent such as zinc oxide and barium sulfate, an antioxidant, a pigment such as titanium oxide, and a color powder as appropriate.

The golf ball of the present invention is not limited, as long as the golf ball has a core consisting of at least one layer and a cover covering the core, wherein at least one layer of the core is obtained by molding a rubber composition which comprises: (a) high-cis/low-trans polydiene, (b) a co-crosslinking agent, and (c) a crosslinking agent. The core consists of at least one layer, and such examples include a single-layered core and a multi-layered core comprising an inner-layer core and an outer layer core. The multi-layer core may be one wherein at least one of the inner-layer core or the outer-layer is obtained by molding the above rubber composition.

The golf ball of the present invention includes, for example, a two-piece golf ball comprising a single-layered core and a cover covering the single-layered core; a three-piece golf ball comprising a single-layered core and an intermediate layer covering the single-layered core and a cover covering the intermediate layer; a multi-piece golf ball having a structure comprising at least four layers; a wound-core golf ball having a wound core and a cover. In the golf ball having the multi-layer structure, the intermediate layer and the innermost layer core may be collectively called the multi-layer core, or the outermost layer cover and the intermediate layer may be collectively called the multi-layer cover.

The diameter of the core is preferably 30 mm or more, more preferably 32 mm or more, and preferably 42 mm or less, more preferably 41.8 mm or less. If the diameter of the core is less than 30 mm, the thickness of the cover needs to be greater than the desired thickness, possibly resulting in lowered resilience. On the other hand, if the diameter of the core is more than 42 mm, the thickness of the cover needs to be less than a desired thickness, so the function of the cover cannot be obtained sufficiently.

The core, if it has a diameter of 30 mm to 42 mm, preferably has a compression deformation amount (an amount the golf ball shrinks along the direction of the compression) of 2.5 mm or more, more preferably 3.0 mm or more and preferably has a compression deformation amount of 5.0 mm or less, more preferably 4.5 mm or less when applying a load from 98 N as an initial load to 1275 N as a final load. If the compression deformation amount is less than 2.5 mm, the shot feeling becomes bad due to hardness, while if it is more than 5.0 mm, the resilience may be lowered.

In a preferred embodiment of the present invention, as the core of the golf ball, a core having the surface hardness larger than the center hardness is used. For example, by employing a multi-layer core structure, the surface hardness of the core which is larger than the center hardness thereof can be readily obtained. The difference of the hardness between the surface hardness and the center hardness of the core is preferably 20 or more, more preferably 25 or more in shore D hardness. If the surface hardness of the core is larger than the center hardness thereof, the launch angle becomes higher and the amount of spin becomes lowered, so that the flying distance is improved. The upper limit of the difference in shore D hardness between the surface hardness and the center hardness is not particularly limited, and is preferably 40, more preferably 38. If the difference of the hardness becomes too large, the durability tends to be lowered.

The center hardness of the core is preferably 30 or more, more preferably 32 or more, even more preferably 35 or more in shore D hardness. If the center hardness of the core is less than 30 in shore D hardness, the core becomes too soft, so that the resilience may become lowered. Additionally, the center hardness of the core is preferably 50 or less, more preferably 48 or less, even more preferably 45 or less in shore D hardness. If the center hardness is more than 50 in shore D hardness, the core becomes too hard, so that the shot feeling tends to be lowered. In the present invention, the center hardness of the core means the hardness obtained by measuring the central point of the cut surface of the core cut into halves with the Shore D type spring hardness tester.

The surface hardness of the core of the golf ball of the present invention is preferably 45 or more, more preferably 50 or more, even more preferably 55 or more in shore D hardness. If the above hardness is less than 45, the core becomes so soft that the resilience may become lowered. Further, the surface hardness of the core is preferably 68 or less, more preferably 62 or less, even more preferably 60 or less in shore D hardness. If the surface hardness is more than 68 in shore D hardness, the core becomes so hard that the shot feeling may become lowered.

In the following, the method for preparing the golf ball of the present invention will be explained based on the embodiment of the two-piece golf ball using as the core the molded body of the rubber composition in a spherical shape, but the present invention is not limited to the two-piece golf ball and the process explained below. First, (a) a base rubber, (b) a co-crosslinking agent, and (c) a crosslinking agent, and, when necessary, further a filler and an additive are blended and kneaded to prepare a rubber composition. The resultant rubber composition is usually heated at a temperature of 130° C. to 200° C. for 10 to 60 minutes. Alternatively, the resultant rubber composition is subjected to a two-step heating, at a temperature of 130° C. to 150° C. for 20 to 40 minutes and continuously for 5 to 15 minutes at a temperature of 160° C. to 180° C. to mold into a molded body in a spherical shape. The resultant molded body in a spherical shape is used as a core, and the core is covered with a cover composition to give a golf ball. As a method of covering with the cover composition, typically employed is a method including previously molding the cover composition into two hemispherical half shells, covering the core together with the two half shells, and subjecting the core with two half shells to the compression molding, or a method including injection-molding the cover composition directly onto the core. Further, when forming the golf ball body by covering the core with the cover composition, the golf ball body can be formed with a plurality of concavities, which is so called "dimple", at the surface thereof. As required, the surface of the golf ball can be subjected to grinding treatment such as sandblast in order to improve the adhesion of the paint film.

The golf ball of the present invention, if it has a diameter of 42.60 mm to 42.90 mm, preferably has a compression deformation amount (an amount the golf ball shrinks along the direction of the compression) of 2.0 mm or more, more preferably 2.1 mm or more, even more preferably 2.2 mm or more, and preferably has a compression deformation amount of 4.5 mm or less, more preferably 4.0 mm or less, even more preferably 3.5 mm or less when applying a load from 98 N as an initial load to 1275 N as a final load. If the compression deformation amount is less than 2.0 mm, the shot feeling becomes bad due to hardness, while if it is more than 4.5 mm, the resilience may be lowered.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Method]

(1) Repulsion Coefficient of Core

A metal cylinder having a weight of 198.4 g was collided with each golf ball core at the speed of 40 m/sec. to measure the speed of the above cylinder and each of the golf ball cores before and after the collisions to calculate the repulsion coefficient of each of the golf ball cores from the speed and the weight thereof. The measurement of 12 golf balls was carried out for each core, and the average was taken as the repulsion coefficient of the core. Each value of the repulsion coefficient of the core was reduced to an index number relative to the value of golf ball No. 2 being assumed 100.

(2) Flying Distance

Each golf ball was hit at the head speed of 45 m/sec with a metal head wood club #1 (XXIO available from SRI Sports Limited, loft angle: 10°) attached to a swing robot produced by TRUETEMPER CO. to measure the flying distance (carry) to the point of fall. The measurement of 12 golf balls was carried out for each core, and the average was taken as the result of the test. The flying distance was reduced to an index number relative to the value of golf ball No. 2 being assumed 100.

(3) Shot Feeling

Actual hitting test was carried out by twenty golfers including ten professional golfers and ten high-level amateur golfers using the metal head wood club #1 (XXIO available from SRI Sports Limited, loft angle: 10°) for evaluation according to the springy feeling when hitting the ball. The most frequent result was taken as the shot feeling of each of the golf balls. The evaluation is based on the following criteria.

G (Good): Springy feeling when hit is strong and good.

F (Fair): Springy feeling when hit is fair.

P (Poor): Springy feeling when hit is weak; rather, it feels heavy.

(4) Compression Deformation Amount (mm)

The compression deformation amount (amount the golf ball shrinks along the compression direction: mm) of the golf balls or the cores was measured when applying a load from 98N (10 kgf) as an initial load to 1275 N (130 kgf) as a final load to the golf balls or the cores.

(5) Method for Determining Cis, Trans and Vinyl Bond in Polydiene

The ratio of 1,2-vinyl bond and (cis-1,4-bond+trans-1,4-bond) can be obtained using $^{1}$H-NMR (refer to FIG. 1). More specifically, in the $^{1}$H-NMR chart obtained by the measurement, the peaks in the vicinity of approximately 5.0 ppm and in the vicinity of approximately 5.4 ppm can be assigned to the peak of 1,2-vinyl bond and the peak of (cis-1,4-bond+trans-1,4-bond), respectively. Since the ratio of 1,2-vinyl bond and (cis-1,4-bond+trans-1,4-bond) is proportional to the area ratio of the peaks thereof, the ratio can be readily calculated.

Figure 2:
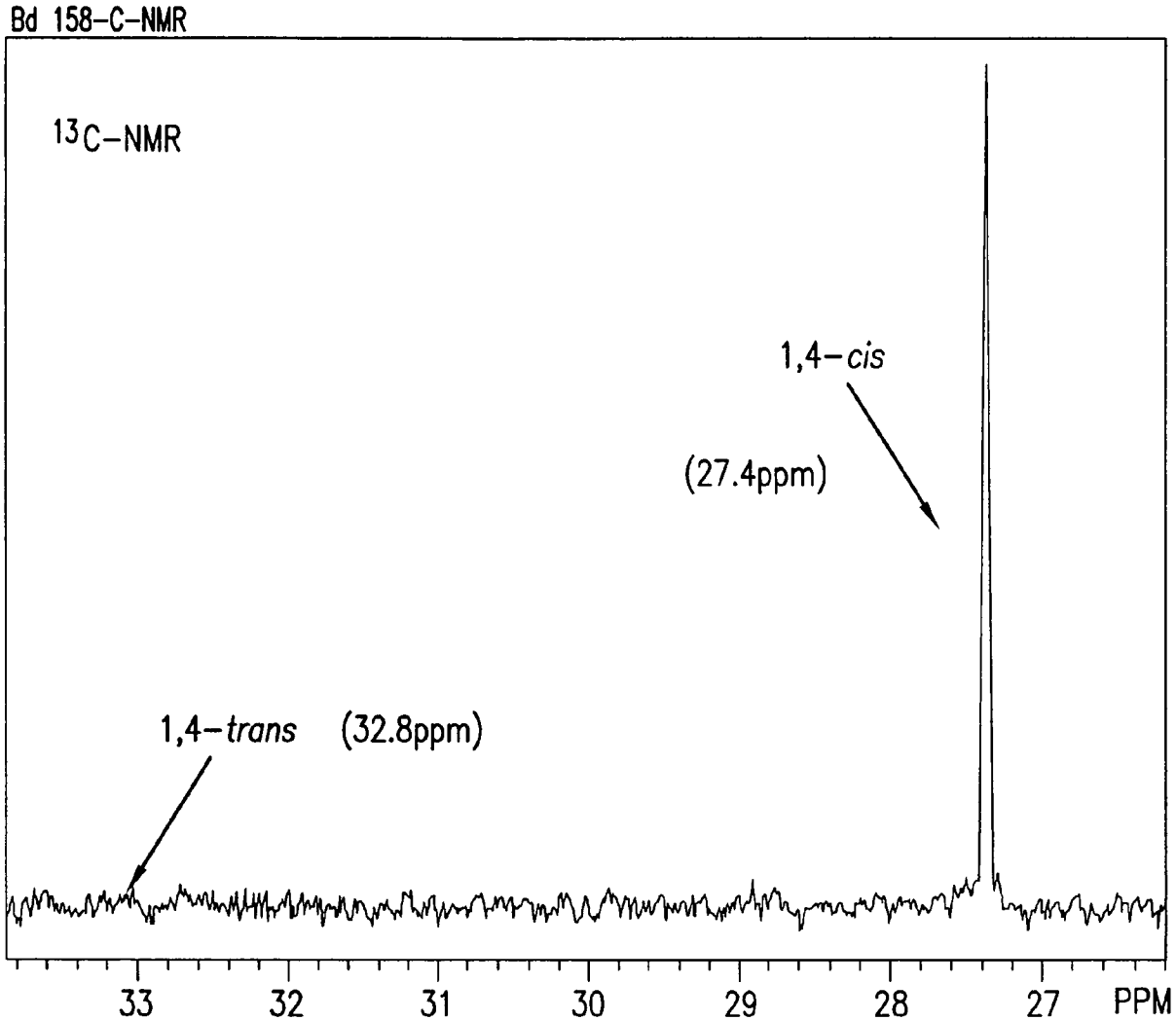
FIG. 2 is a $^{13}$C-NMR chart showing an example of the polybutadiene.

In addition, the ratio of cis-1,4-bond and trans-1,4-bond can be obtained using $^{13}$C-NMR (refer to FIG. 2). More specifically, in the $^{13}C$-NMR obtained by the measurement, the peak of 27 to 28 ppm and the peak in the vicinity of 33 ppm can be assigned to cis-1,4-bond and trans-1,4-bond, respectively. Since the ratio of cis-1,4-bond and trans-1,4-bond is proportional to the area ratio of the peaks thereof, the ratio can be readily calculated.

In the present invention, JOEL α-400NMR available from JEOL Ltd. was used for the measurement.

[Preparation of Metallosalen Complex]

Metallosalen Complex 1

15 g (0.064 mol) of 3,5-di-tert-butyl salicylaldehyde was dissolved in 500 ml of methanol, and then 1.92 g (0.032 mol) of ethylenediamine was added, and stirred at room temperature for 2 hours. The reaction product thus obtained was filtrated to give 13.3 g (0.0266 mol) of N,N'-bis(3,5-di-tert-butylsalicylidene)ethylenediamine. Next, in a solution obtained by dissolving the above compound in 1000 g of methanol, $Co(OAc)_2.4H_2O$ was added in an amount of 8.753 g (0.0266 mol), followed by reflux for two hours, and the product thus obtained was subjected to filtration to give a metallosalen complex 1 (N,N'-bis(3,5-di-tert-butylsalicylidene)ethylenediaminato cobalt(II)). The yield was 70%.

Metallosalen Complex 2

Except that 11.4 g (0.064 mol) of 3-tert-butylsalicylaldehyde was used instead of 15 g (0.064 mol) of 3,5-di-tert-butylsalicylaldehyde, metallosalen complex 2 (N,N'-bis(3-tert-butylsalicylidene)ethylenediaminato cobalt(II)) was obtained in the same manner as the metallosalen complex 1. The yield was 45%.

Metallosalen Complex 3

Except that 6.79 g (0.032 mol) of 1,2-diphenyl ethylenediamine was used instead of 1.92 g (0.032 mol) of ethylenediamine, metallosalen complex 3 (N,N'-bis(3,5-di-tert-butylsalicylidene)1,2-diphenylethylenediaminato cobalt(II)) was obtained in the same manner as the metallosalen complex 1. The yield was 60%.

[Preparation of High-cis/Low-trans Polybutadiene]

Interior of an autoclave having the capacity of 2 litter was displaced with nitrogen, and 1200 ml of methylene chloride was supplied, followed by charging of 150 ml of 1,3-butadiene therein. Then, the cobalt salen complex and the methylaluminoxane (MAO: Tosoh Akzo Corporation, FW=58.02) obtained as described above were added in this order so that the molar ratio of aluminum and the cobalt becomes 500 (MAO/Co=500). The polymerization was conducted at room temperature. The 1,3-butadiene, the metallosalen complex and the methylaluminoxane were charged in a ratio of 1,3-butadiene:metallosalen complex:methylaluminoxane=100:0.0558:27.9 (molar ratio). After the polymerization, 2 litter of methanol containing 10 mass % of BHT was added to inhibit the reaction, and the resultant polymer was separated using a large amount of a mixed solution of methanol/hydrochloric acid and vacuum-dried at the temperature of 60° C. The content of each of the bonds in the high-cis/low-trans polybutadiene thus obtained and a commercially available high cis-polybutadiene were measured, and the result is shown in Table 1.

TABLE 1

| | Catalyst | 1,3-Bd:Salen:MAO | | Molecular weight | | Content of bond (% by mass) | | |
|---|---|---|---|---|---|---|---|---|
| | | | | Weight | Number | | | |
| Base rubber | Type | Molar ratio | Mass ratio | average | average | Trans-1,4 | Cis-1,4 | Vinyl-1,2 |
| BR51 | Nd-based catalyst | — | — | 560000 | 190000 | 2.4 | 97.5 | 0.1 |
| BR01 | Ni-based catalyst | — | — | 632000 | 180000 | 1.5 | 97.2 | 1.3 |
| BR730 | Nd-based catalyst | — | — | 745000 | 267000 | 0.9 | 98.9 | 0.2 |
| High-cis/low-trans polybutadiene 1 | Metallo Salen complex 1 | 100:0.056:27.9 | 100:0.57:30 | 530000 | 160000 | 0.0 | 99 | 1.0 |
| High-cis/low-trans polybutadiene 2 | Metallo Salen complex 2 | 100:0.056:27.9 | 100:0.45:30 | 592000 | 164000 | 0.2 | 98.2 | 1.6 |
| High-cis/low-trans polybutadiene 3 | Metallo Salen complex 3 | 100:0.056:27.9 | 100:0.73:30 | 604000 | 173000 | 0.0 | 99.2 | 0.8 |

As apparent from the result shown in Table 1, a polybutadiene (high-cis/low-trans polybutadiene) obtained by polymerizing 1,3-butadiene in the presence of a catalyst containing the metallosalen complex and the methylaluminoxane is low in the content of trans-1,4 bond compared with a commercially available high cis-polybutadiene.

[Preparation of Golf Ball Body]

(1) Preparation of Core

The rubber composition for the core shown in Tables 2 and 3 was kneaded by a kneading roll and then was subjected to heat-pressing in upper and lower molds having spherical cavities at the temperature of 170° C. for 20 minutes to obtain a spherical core having a diameter of 40 mm. Golf balls Nos. 4 and 5 have the multi-layer core comprising an inner-layer core and an outer layer core. Golf ball No. 4 is the case where the inner-layer core was covered with the rubber composition containing high-cis/low-trans polybutadiene and is subjected to heat-pressing to mold an outer-layer core, while Golf ball No. 5 is the case where an ionomer resin was injection-molded on the inner-layer core to form an outer layer core.

TABLE 2

| | Golf ball No. | | | | |
|---|---|---|---|---|---|
| | No. 1 | No. 2 | No. 3 | No. 4 | No. 5 |
| Inner layer core | | | | | |
| BR51 | — | — | — | — | — |
| BR01 | | | | | |
| BR730 | — | — | — | — | — |
| High-cis/low-trans polybutadiene 1 | 100 | — | — | — | — |
| High-cis/low-trans polybutadiene 2 | — | 100 | — | — | — |
| High-cis/low-trans polybutadiene 3 | — | — | 100 | 100 | 100 |
| Zinc acrylate | 29 | 29 | 29 | 27 | 27 |
| Zinc oxide | Appropriate amount | Appropriate amount | Appropriate amount | Appropriate amount | Appropriate amount |
| Dicumyl peroxide | 1 | 1 | 1 | 1 | 1 |
| Diphenyl disulfide | — | — | — | — | — |
| Outer layer core | | | | | |
| High-cis/low-trans polybutadiene 3 | — | — | — | 100 | — |
| Zinc acrylate | — | — | — | 41 | — |
| Zinc oxide | — | — | — | 10 | — |
| Dicumyl peroxide | — | — | — | 0.7 | — |
| Diphenyl disulfide | — | — | — | 0.5 | — |
| Himilan 1605 | — | — | — | — | 50 |
| Himilan 1706 | — | — | — | — | 50 |
| Properties of core | | | | | |
| Diameter of core (thickness of outer layer in case of twor layers): mm | 40 | 40 | 40 | 40(3.6) | 40(1.6) |
| Center hardness of core (Shore D) | 32 | 33 | 32 | 37 | 38 |
| Surface hardness of core (Shore D) (surface of outer layer in case of two layers) | 57 | 58 | 57 | 60 | 68 |
| Difference of hardness of core (Shore D) | 25 | 25 | 25 | 23 | 30 |
| Compression deformation amount of core (mm) | 3.1 | 3.12 | 3.08 | 2.8 | 2.9 |
| Repulsion coefficient of core | 101 | 100 | 102 | 105 | 104 |
| Cover | | | | | |
| Himilan 1605 | 50 | 50 | 50 | 50 | 50 |
| Himilan 1706 | 50 | 50 | 50 | 50 | 50 |
| Titanium oxide | 4 | 4 | 4 | 4 | 4 |
| Properties | | | | | |
| Golf ball compression deformation amount (mm) | 2.5 | 2.52 | 2.48 | 2.2 | 2.3 |
| Flying distance of driver | 101 | 100 | 102 | 106 | 105 |
| Shot feeling | F | F | G | G | G |

Formulation (part by mass): The content of zinc oxide was suitably adjusted so that the mass of the golf ball became 45.4 g.

TABLE 3

| | Golf ball No. | | | | |
|---|---|---|---|---|---|
| | No. 6 | No. 7 | No. 8 | No. 9 | No. 10 |
| Inner layer core | | | | | |
| BR51 | — | — | 100 | — | — |
| BR01 | — | — | — | 100 | — |
| BR730 | 50 | — | — | — | 100 |
| High-cis/low-trans polybutadiene 1 | — | — | — | — | — |
| High-cis/low-trans polybutadiene 2 | — | — | — | — | — |
| High-cis/low-trans polybutadiene 3 | 50 | 100 | — | — | — |
| Zinc acrylate | 29 | 33 | 29 | 29 | 29 |
| Zinc oxide | Appropriate amount | Appropriate amount | Appropriate amount | Appropriate amount | Appropriate amount |
| Dicumyl peroxide | 1 | 1 | 1 | 1 | 1 |
| Diphenyl disulfide | — | 0.5 | — | — | — |
| Outer layer core | | | | | |
| High-cis/low-trans polybutadiene 3 | — | — | — | — | — |
| Zinc acrylate | — | — | — | — | — |
| Zinc oxide | — | — | — | — | — |

TABLE 3-continued

| | Golf ball No. | | | | |
|---|---|---|---|---|---|
| | No. 6 | No. 7 | No. 8 | No. 9 | No. 10 |
| Dicumyl peroxide | — | — | — | — | — |
| Diphenyl disulfide | — | — | — | — | — |
| Himilan 1605 | — | — | — | — | — |
| Himilan 1706 | — | — | — | — | — |
| Properties of core | | | | | |
| Diameter of core (thickness of outer layer in case of twor layers): mm | 40 | 40 | 40 | 40 | 40 |
| Center hardness of core (Shore D) | 32 | 30 | 33 | 34 | 33 |
| Surface hardness of core (Shore D) (surface of outer layer in case of two layers) | 56 | 58 | 56 | 55 | 57 |
| Difference of hardness of core (Shore D) | 24 | 28 | 23 | 21 | 24 |
| Compression deformation amount of core (mm) | 3.06 | 3.07 | 3.12 | 3.13 | 3.11 |
| Repulsion coefficient of core | 102 | 104 | 97 | 96 | 98 |
| Cover | | | | | |
| Himilan 1605 | 50 | 50 | 50 | 50 | 50 |
| Himilan 1706 | 50 | 50 | 50 | 50 | 50 |
| Titanium oxide | 4 | 4 | 4 | 4 | 4 |
| Properties | | | | | |
| Golf ball compression deformation amount (mm) | 2.46 | 2.47 | 2.52 | 2.53 | 2.51 |
| Flying distance of driver | 102 | 104 | 96 | 95 | 97 |
| Shot feeling | G | G | P | P | P |

Formulation (part by mass): The content of zinc oxide was suitably adjusted so that the mass of the golf ball became 45.4 g.

Notes on Tables 2 and 3

Polybutadiene rubber: BR51, BR01 and BR730 (content of cis: 96% or more) produced by JSR Zinc acrylate: ZNDA-90S produced by NIHON JYORYU KOGYO Co., LTD.

Zinc oxide: "Ginrei R" produced by Toho-Zinc

Dicumyl peroxide: Percumyl D produced by NOF Corporation

Diphenyl disulfide: produced by Sumitomo Seika Chemicals Company Limited (2) Formulation of Cover Materials The cover materials shown in Tables 2 and 3 were mixed using a twin-screw kneading extruder to obtain the cover composition in the form of pellet. The extrusion was conducted in the following conditions: screw diameter=45 mm, screw revolutions=200 rpm, screw L/D=35, and the cover composition was heated to from 200° C. to 260° C. at the die position of the extruder.

Himilan 1605: a sodium ion-neutralized ethylene-methacrylic acid copolymer ionomer resin available from MITSUI-DUPONT POLYCHEMICAL Himilan 1706: a zinc ion-neutralized ethylene-methacrylic acid copolymer ionomer resin available from MITSUI-DUPONT POLYCHEMICAL (3) Molding of Cover The resultant cover composition was injection-molded onto the core thus obtained to form the cover covering the core having a thickness of 1.4 mm. The upper and lower molds for forming the cover have a spherical cavity with pimples. The part of the pimples can serve as a hold pin which is retractable. When forming the golf ball body, the hold pins were protruded to hold the core, and the resin heated at 210° C. was charged into the mold held under the pressure of 80 tons for 0.3 seconds. After the cooling for 30 seconds, the molds were opened and then the golf ball was discharged.

The surface of the obtained golf ball was subjected to the sand-blast treatment, and then the mark was printed and the clear paint was coated on the surface of the golf ball respectively. The paint was dried in an oven kept at 40° C. to obtain the golf ball having a diameter of 42.8 mm and a mass of 45.4 g. The evaluation results of the resultant golf balls with regard to compression deformation amount of the core, repulsion coefficient of the core, flying distance and shot feeling are collectively shown in Tables 2 and 3.

As apparent from Tables 2 and 3, golf balls Nos. 1 to 7 of the present invention using high-cis/low-trans polybutadiene for the core have proven to be excellent in resilience (flying distance) and shot feeling.

The present invention is suitable for use in a golf ball having a core and a cover such as a two-piece golf ball, a three-piece golf ball, a multi-piece golf ball and a wound-core golf ball. This application is based on Japanese Patent application No. 2,006-133,110 filed on May 11, 2006, and Japanese Patent application No. 2,006-355,732 filed on Dec. 28, 2006, and the contents of which are hereby incorporated by reference.

What is claimed is:

1. A golf ball having a core consisting of at least one layer and a cover covering the core, wherein at least one layer of the core is obtained by molding a rubber composition which comprises (a) a base rubber containing a polybutadiene obtained by polymerizing butadiene in the presence of a catalyst containing a cobalt salen complex and methylaluminoxane;

(b) a co-crosslinking agent; and (c) a crosslinking agent, and the polybutadiene contains 98% or more of cis-1,4-bond and 1% or less of trans-1,4-bond, and the golf ball having a difference in hardness between surface hardness and center hardness of 20 or more, 40 or less in shore D hardness, a center hardness of 30 or more, 50 or less in shore D hardness and a surface hardness of 45 or more, 68 or less in shore D hardness.

2. The golf ball according to claim 1, wherein the core has a diameter of 30 mm to 42 mm.

3. The golf ball according to claim 1, wherein the polybutadiene contains 0.5% or less of the trans-1,4-bond.

4. The golf ball according to claim 3, wherein the butadiene is a butadiene selected from the group consisting of 1,3-butadiene, 2-methyl-1,3-butadiene, 2-ethyl-1,3-butadiene, 2,3-dimethyl-1,3-butadiene.

5. The golf ball according to claim 4, wherein the core has a diameter of 30 mm to 42 mm.

6. The golf ball according to claim 3, wherein the butadiene is 1,3-butadiene.

7. The golf ball according to claim 6, wherein the cobalt salen complex is at least one member selected from the group consisting of N,N'-bis(3-tert-butylsalicylidene)ethylenediaminato Cobalt(II), N,N'-bis(3-tert-butyl-5-methylsalicylidene)ethylenediaminato Cobalt(II), N,N'-bis(3,5-di-tert-butylsalicylidene)ethylenediaminato Cobalt(II), and N,N'-bis(3,5-di-tert-butylsalicylidene)1,2-diphenylethylenediaminato Cobalt(II).

8. The golf ball according to claim 7, wherein the core has a diameter of 30 mm to 42 mm.

9. The golf ball according to claim 8, wherein the butadiene is a butadiene selected from the group consisting of 1,3-butadiene, 2-methyl-1,3-butadiene, 2-ethyl-1,3-butadiene, 2,3-dimethyl-1,3-butadiene.

10. The golf ball according to claim 7, wherein the rubber composition contains:

(b) 15 parts to 45 parts of the co-crosslinking agent by mass, and (c) 0.2 part to 5 parts of the crosslinking agent by mass, relative to 100 parts by mass of (a) the base rubber.

11. The golf ball according to claim 10, wherein the polybutadiene contains 0.3% or less of the trans-1,4-bond.

* * * * *